US008387198B2

(12) United States Patent
Rodriguez

(10) Patent No.: US 8,387,198 B2
(45) Date of Patent: Mar. 5, 2013

(54) PAINT BRUSH EXTENSION FASTENER

(76) Inventor: Raul Rodriguez, Tavernier, FL (US)

( * ) Notice: Subject to any disclaimer, the term of this patent is extended or adjusted under 35 U.S.C. 154(b) by 0 days.

(21) Appl. No.: 13/209,921

(22) Filed: Aug. 15, 2011

(65) Prior Publication Data

US 2012/0036664 A1 Feb. 16, 2012

Related U.S. Application Data

(60) Provisional application No. 61/373,856, filed on Aug. 15, 2010.

(51) Int. Cl.
*A46B 17/02* (2006.01)
*B25G 3/16* (2006.01)

(52) U.S. Cl. ..... 15/145; 15/144.3; 15/146

(58) Field of Classification Search ..... 15/145, 15/146, 144.3
See application file for complete search history.

(56) References Cited

U.S. PATENT DOCUMENTS

| | | | | |
|---|---|---|---|---|
| 3,319,280 | A * | 5/1967 | Trachsler | 15/146 |
| D263,677 | S | 4/1982 | Clark | |
| 4,525,889 | A * | 7/1985 | Dunau | 15/146 |
| 5,172,447 | A * | 12/1992 | Tomm | 15/159.1 |
| 6,101,657 | A | 8/2000 | Hamilton | |
| D456,147 | S | 4/2002 | Anderson | |
| 7,065,824 | B2 * | 6/2006 | Petner | 15/145 |

* cited by examiner

*Primary Examiner* — Randall Chin
(74) *Attorney, Agent, or Firm* — Allen, Dyer, Doppelt, Milbrath & Gilchrist, P.A.

(57) ABSTRACT

A paintbrush holder assembly affixes a standard paintbrush to a holder that in turn engages an extension rod. The holder includes a hollow tubular shaft with a circular cross section that includes a first end, a middle portion and a second end. Three or more semi-circular fasteners attach to the middle portion of the tubular shaft via flex points. One fastener includes a lock pin to engage a locking shaft. The locking shaft has an "L" shaped lock track having a sufficient size and dimension to fit about the tubular shaft and capable of sliding from the second end to a point proximate the first end. The extension rod connects to the holder via male threads which secure to female threads located at the second end of the tubular shaft.

5 Claims, 5 Drawing Sheets

PAINT BRUSH EXTENSION FASTENER

CROSS-REFERENCE TO RELATED APPLICATIONS

This application claims priority to U.S. Provisional Patent Application Ser. No. 61/373,856, filed on Aug. 15, 2010, the contents and disclosure of which are hereby incorporated by reference.

FIELD OF THE INVENTION

This invention is generally directed to a paint brush extension fastener. More specifically, the invention relates to a fastener that may engage a variety of varying sized paintbrushes so as to affix an extension rod to allow a user to paint elevated and hard to reach areas.

BACKGROUND OF THE INVENTION

When painting a residential or commercial facility, there are typically three types of paint systems used to affix paint to a surface. The first is a spray system that allows high velocity particulates of paint to be applied to the surface. The second system is a roller system that allows the paint to be rolled upon a large surface area. The third means for paining a surface is through a paintbrush, which is typically used in small finite areas such as proximate windows, moldings and related wall fixtures.

While a paintbrush is often preferred for difficult and small areas, one drawback occurs when such area is in a high elevation or remains difficult to reach without use of a ladder or scaffolding. One way to address this problem is by affixing the paintbrush to an extension rod. There exist a few antiquated designs that address a fastener for a paintbrush, all of which include multiple limitations and drawbacks.

One such example is Design Pat. No. D263,677 entitled "Paint Brush Extension Clamp" by Charles A. Clark which issued on Apr. 6, 1982. Under the Clark system, the clamp includes a first plate and a corresponding second plate in parallel relation with the first. Both plates are compressed by a series of four screws so as to engage the paintbrush. While the system allows the benefit of providing a variety of angled positions for the paintbrush, it is also susceptible to slippage. Moreover, there such assembly requires a large degree of time so as to engage the four screws about the paintbrush.

A second example of a prior art paint brush holder is U.S. Design Pat. No. D456,147 entitled "Extendable Universal Paint Brush Holder," issued to Charles Anderson on Apr. 30, 2002. The Anderson system includes a "U" shaped flexible holder having a first fastener and a corresponding second fastener—both in parallel relationship to each other. Both parallel members may engage a paint brush through twisting a single screw which reduces the spacing between both parallel fasteners. Again, this design requires time necessary to twist the screw, and likewise risks dislodging the paintbrush.

Others patents suggest use of a screw based system to engage the paintbrush to an extension rod. Take, for example, U.S. Pat. No. 6,101,657 entitled "Applicator having an Extension," issued to Andrew Hamilton on Aug. 15, 2000. However, such screw-based systems have many drawbacks, including the fact that the user may have to be non-standard (and likely more expensive) paint brushes.

Accordingly, there is a need in the art of paint brush extension fasteners for a device that allows use of standard paintbrushes but allows the quick and efficient ability to engage the off-the-shelf paintbrush without the need, time or annoyance of screwing varying fasteners in place.

SUMMARY OF THE INVENTION

This invention solves the current limitations in the art of paintbrush holders and extension devices. Moreover, the invention teaches a holder that allows for a standard paintbrush to be affixed without need for twisting and securing screws.

The invention is directed to a paintbrush holder assembly capable of affixing a standard paintbrush to a holder that in turn engages an extension rod. The holder may include a hollow tubular shaft with a circular cross section that includes a first end, a middle portion and a second end. Three or more semi-circular fasteners may be attached to the middle portion of the tubular shaft via flex points. One fastener includes a lock pin to engage a locking shaft.

The locking shaft may comprise an "L" shaped lock track having a sufficient size and dimension to fit about the tubular shaft and capable of sliding from the second end to a point proximate the first end. The extension rod connects to the holder via male threads which secure to female threads located at the second end of the tubular shaft.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overall Components of the Paintbrush Holder Assembly

Figure 1:
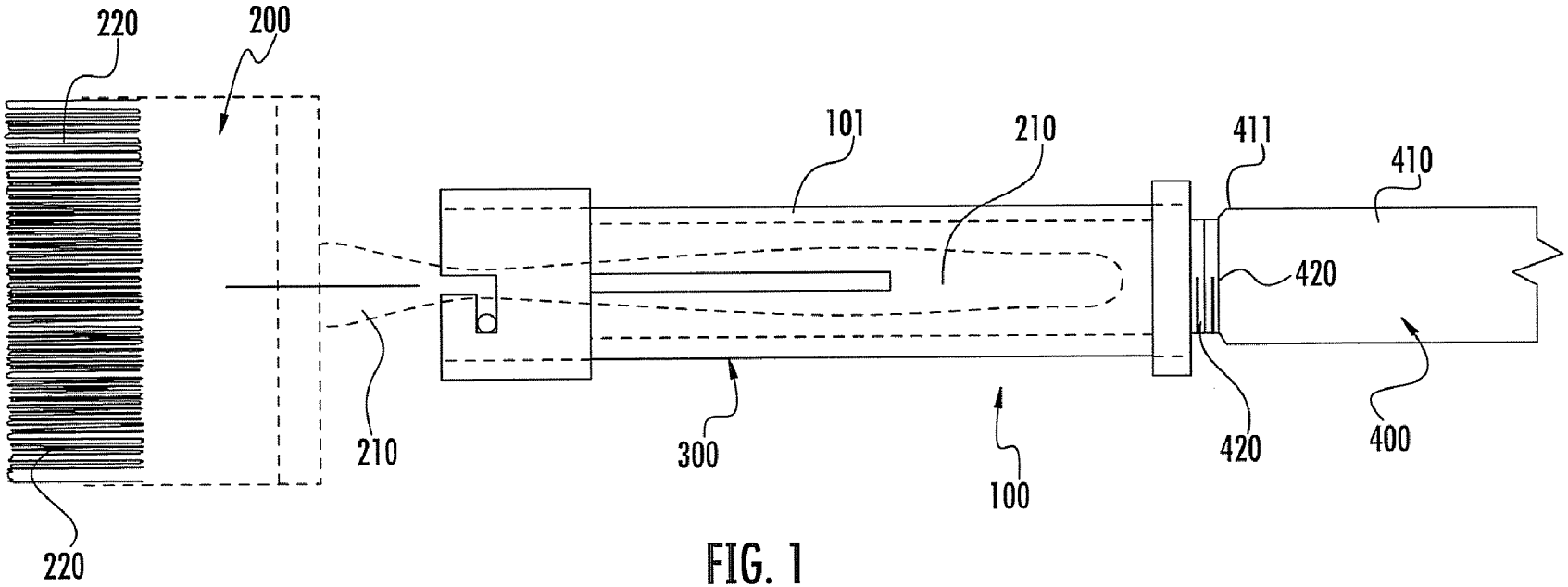
FIG. 1 is a side view illustrating how the paintbrush holder engages a standard paintbrush via four fasteners as well as allows for affixing an extension rod.

FIG. 1 illustrates, by way of example, the overall components of the paintbrush holder assembly 100. As shown by way of example, three primary components 101 for the contemplated assembly 100 include a paintbrush 200, a holder 300, and an extension rod 400. The paintbrush 200 contemplated by the invention is any off-the-shelf and commercially available paintbrush 200 having a handle 210 and a plurality of bristles 220. Such handle 210 can be made of any standard material such as metal, plastic or wood.

As further shown in FIG. 1, the extension rod 400 includes a pole 410 having a first end 411. Positioned proximate the first end 411 is a series of male threads 420. These male threads 420 are sufficient to engage and connect to the holder 300 as described in greater detail below.

The Paintbrush Holder

Figure 2:
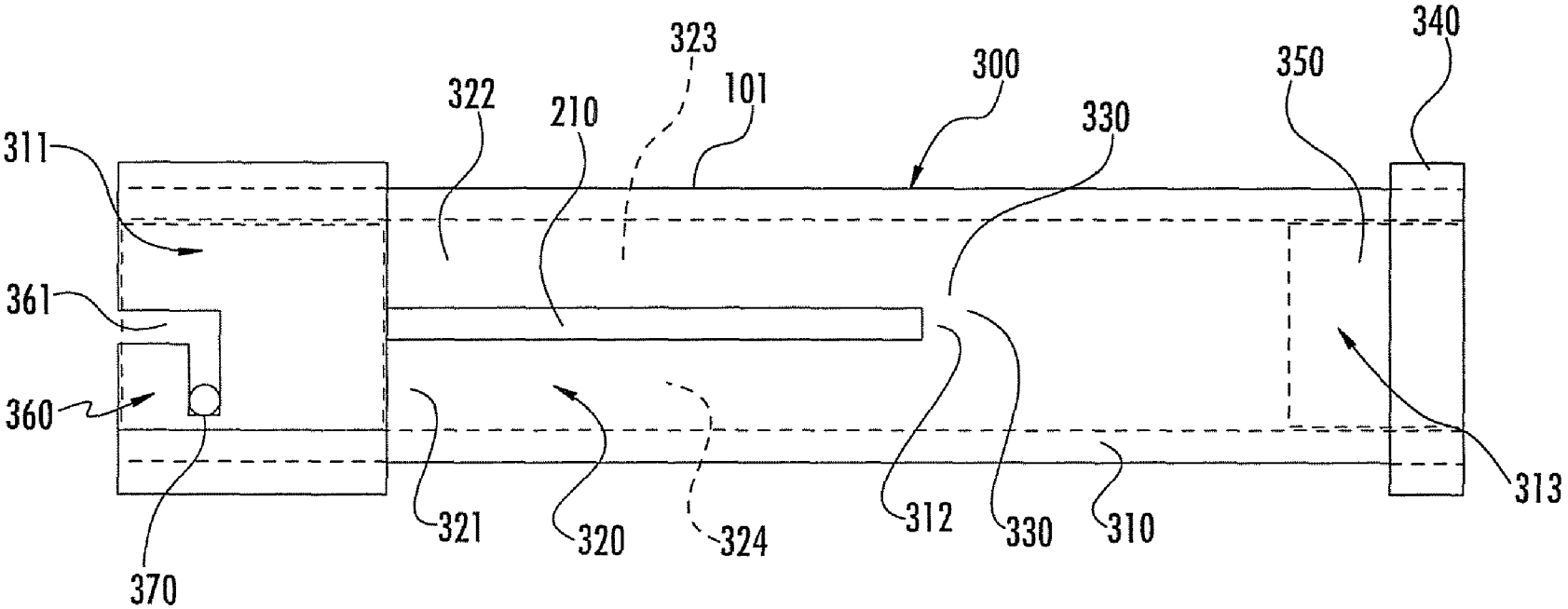
FIG. 2 is a side view showing the various components of the paintbrush holder.
Figure 3:
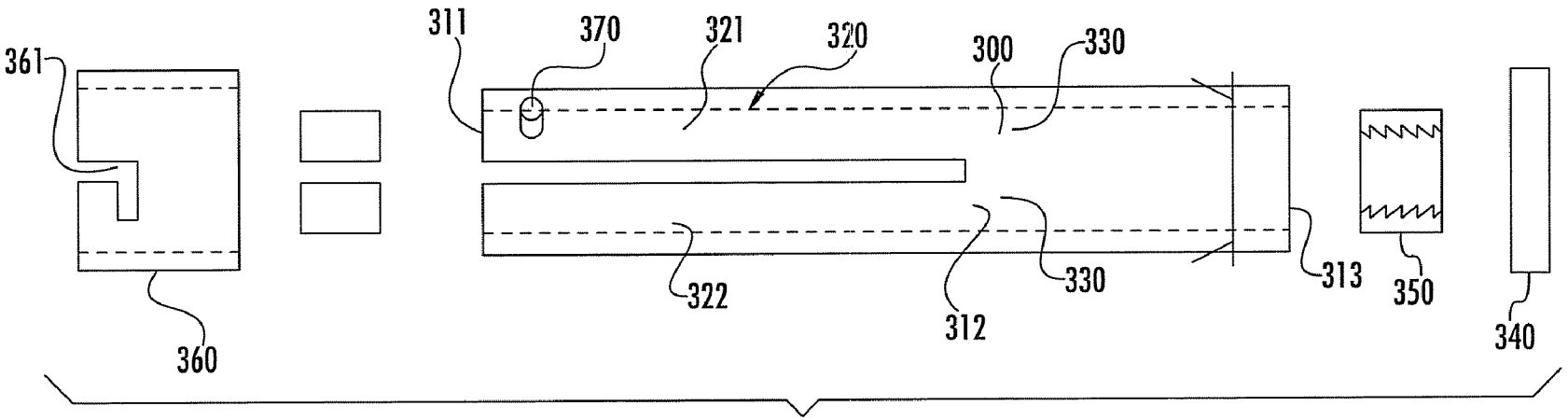
FIG. 3 is an exploded side view showing the various components of the paintbrush holder.

Both FIG. 2 and FIG. 3 illustrate, by way of example, the salient components 101 of the paintbrush holder 300. First turning to FIG. 2, the central component of the paintbrush 300 is a tubular shaft 310. As shown, the tubular shaft 310 is essentially circular in cross section. The internal diameter of the tubular shaft 310 is of a sufficient size and dimension so as to hold and maintain the handle 210 of a standard paintbrush 200. Such tubular shaft 310 is both lightweight and resilient. Moreover, the tubular shaft 310 is preferably made of a polymer or composite material, such as a plastic or PVC.

Figure 4:
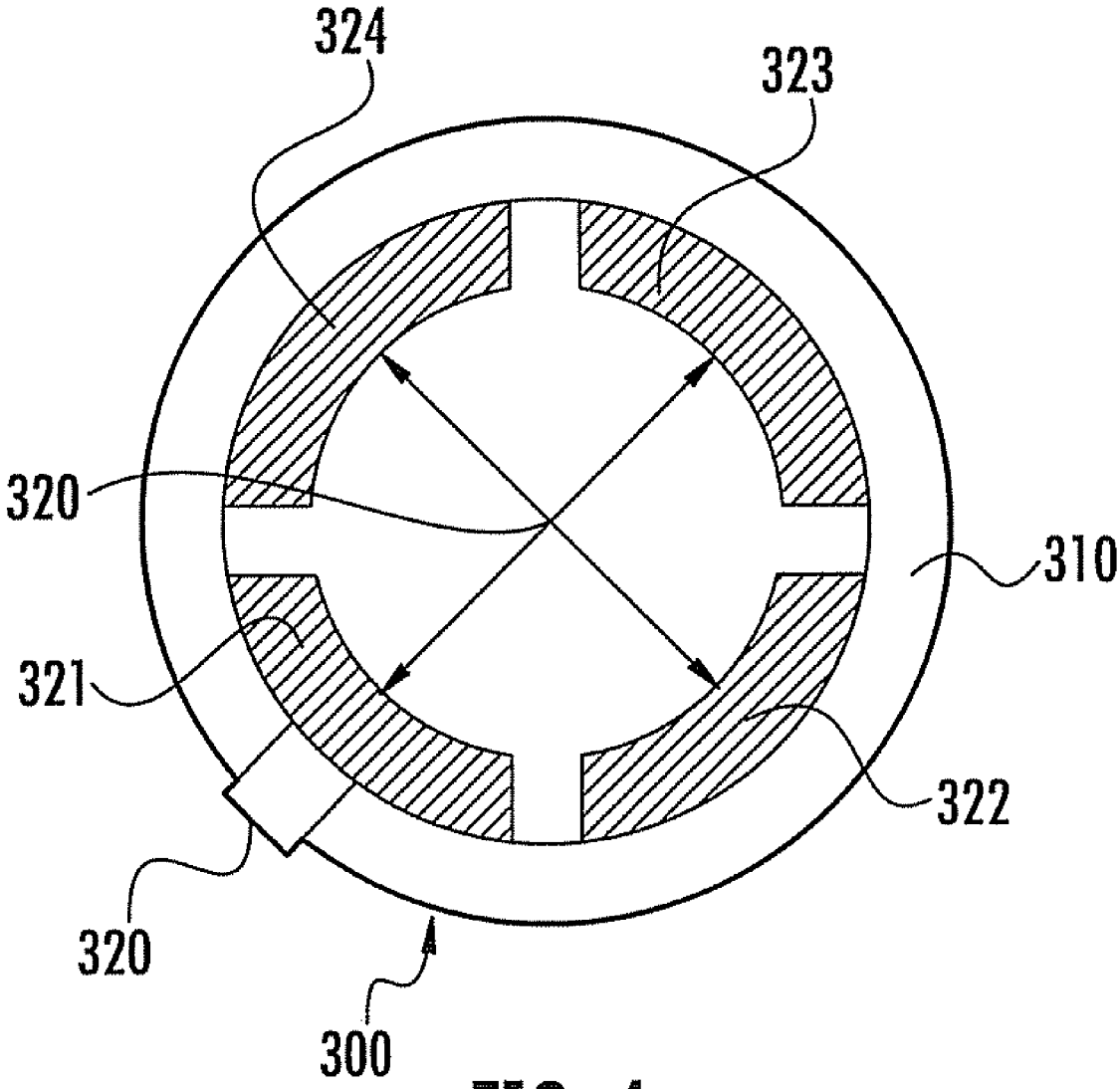
FIG. 4 is a first side view of the paintbrush holder.

As further shown in FIG. 3, the tubular shaft 310 includes a first end 311, a middle portion 312 and a second end 313. Positioned between the first end 311 and the middle portion 312 of the tubular shaft 310 are three or more semi-circular fasteners 320. The embodiment shown in FIG. 2 and FIG. 3 illustrates use of four semi-circular fasteners 320: a first fastener 321, a second fastener 322, a third fastener 323, and a fourth fastener 324. The four fasteners 321-324 are shaped to conform to the diameter of the tubular shaft 310. Moreover, they also form a sufficient hollowed portion to likewise allow entry of a standard paintbrush 300. FIG. 4 is a side view proximate the first end 311 illustrating the four fasteners 321-324.

As shown in FIG. 2, the middle portion 312 of the tubular shaft 310 includes flex points 330. Each flex point 330 corresponds to a fastener 320. These flex points 330 help increase the internal diameter about the first end 311 of the tubular shaft 310 to receive the handle 210 of a standard paintbrush 200 by allowing the first end of the holder 300 to radially expand.

Figure 5:
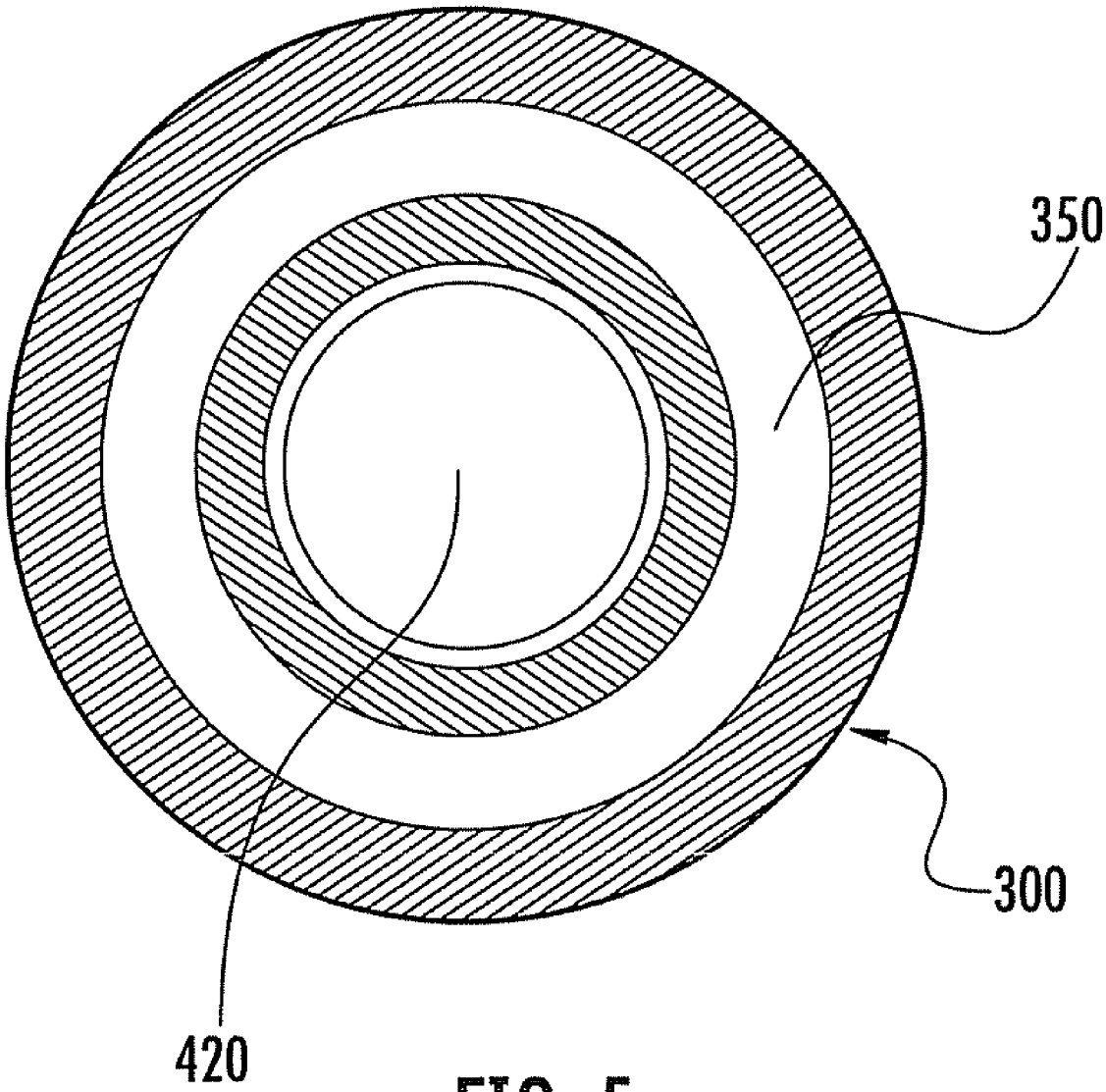
FIG. 5 is a second side view of the paintbrush holder.

Further illustrated in FIG. 3, the second end 313 of the tubular shaft 310 includes two components 101: a base sleeve 340 and female threads 350. As further shown in FIG. 5, the female threads 350 are of a sufficient size and dimension to communicate and engage with the male threads 420 of the extension rod 400. Moreover, the base sleeve 340 is preferably a ring affixed about the exterior of the tubular shaft 310 near the second end 313. Such base sleeve 340 may also be elongated such that it acts as a shield to catch any stray paint while painting.

Both FIG. 2 and FIG. 3 illustrate use of a locking sleeve 360 about the tubular shaft 300. The locking sleeve 360 includes an "L" shaped lock track 361 of a sufficient size and dimension to engage a lock pin 370 positioned about the first fastener 321 of the tubular shaft 310. As shown, the locking sleeve 360 has a sufficient size to fit about the tubular shaft 310 and slide from the base sleeve 340, through the middle portion 312, and up until proximate the first end 311. Through this action of sliding about the tubular shaft 310, the locking sleeve 360 applies pressure about the three or more fasteners 320 which in turn rigidly engages and then secures the paint brush 200.

That which is claimed is:

1. A paintbrush holder assembly comprising:

a holder having a tubular shaft with an essentially circular cross section that includes a first end, a middle portion and a second end, wherein the second end includes first threads;

three or more semi-circular fasteners each attached to the middle portion of the tubular shaft via flex points, wherein one fastener includes a lock pin;

a locking shaft having a lock track capable of engaging the lock pin, the locking shaft having a sufficient size and dimension to fit about the tubular shaft and capable of sliding from the second end to a point proximate the first end; and an extension rod having second threads at one end sufficient to engage and secure to the first threads of the tubular shaft.

2. The assembly of claim 1, further comprising a base sleeve including a ring affixed about an exterior of the tubular shaft near the second end of the tubular shaft.

3. The assembly of claim 1, wherein the lock track is essentially "L" shaped.

4. The assembly of claim 1, wherein the holder includes four semi-circular fasteners.

5. The assembly of claim 1, wherein the holder is made of a polymer.

* * * * *